United States Patent [19]

Spiteri

[11] 4,310,874

[45] Jan. 12, 1982

[54] GROUNDED DUAL VOLTAGE TROUBLE LIGHT AND EXTENSION CORD

[76] Inventor: Joseph Spiteri, P.O. Box 158, Harborcreek, Pa. 16421

[21] Appl. No.: 123,700

[22] Filed: Feb. 22, 1980

[51] Int. Cl.[3] ..... F21V 23/04; H01R 11/00

[52] U.S. Cl. ..... 362/251; 339/28; 362/376; 362/394; 362/396

[58] Field of Search ..... 362/376, 396, 394, 251; 339/28

[56] References Cited

U.S. PATENT DOCUMENTS

| | | | |
|---|---|---|---|
| 2,812,423 | 11/1957 | Penna | 362/376 |
| 3,761,862 | 9/1973 | Spiteri | 339/28 |
| 4,232,357 | 11/1980 | Dietz | 362/430 |

*Primary Examiner*—Benjamin R. Padgett
*Assistant Examiner*—Irwin Gluck
*Attorney, Agent, or Firm*—Ralph Hammar

[57] ABSTRACT

A grounded trouble light and extension cord which permits light and power to be obtained alternatively from a battery or from an A.C. outlet.

3 Claims, 4 Drawing Figures

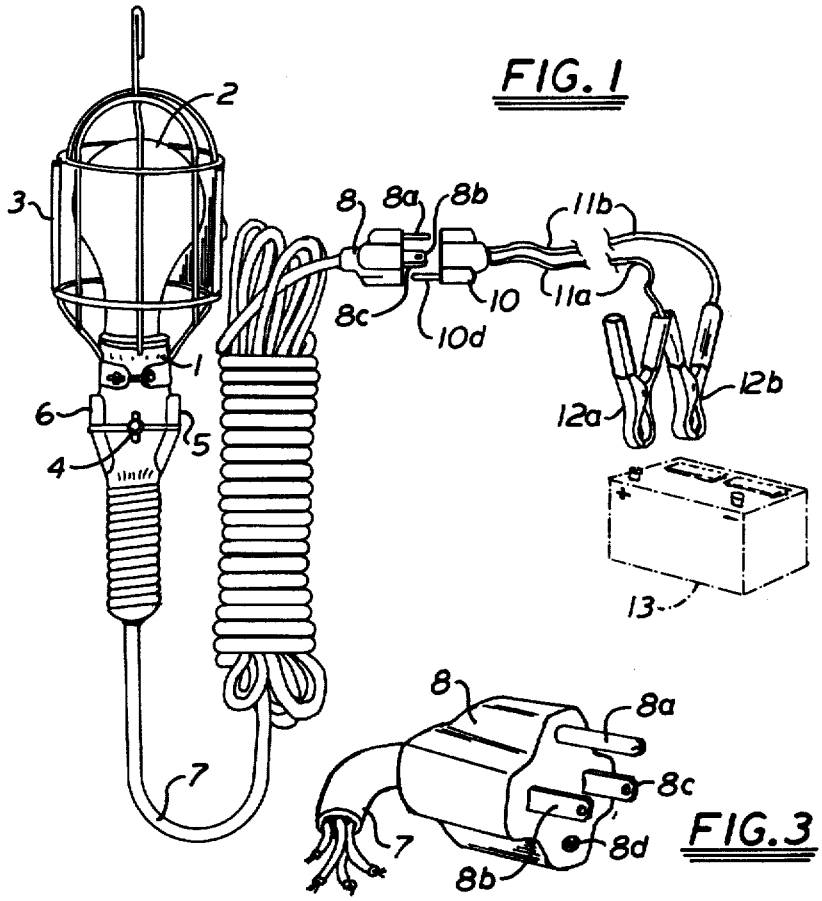
FIG. 1
FIG. 3
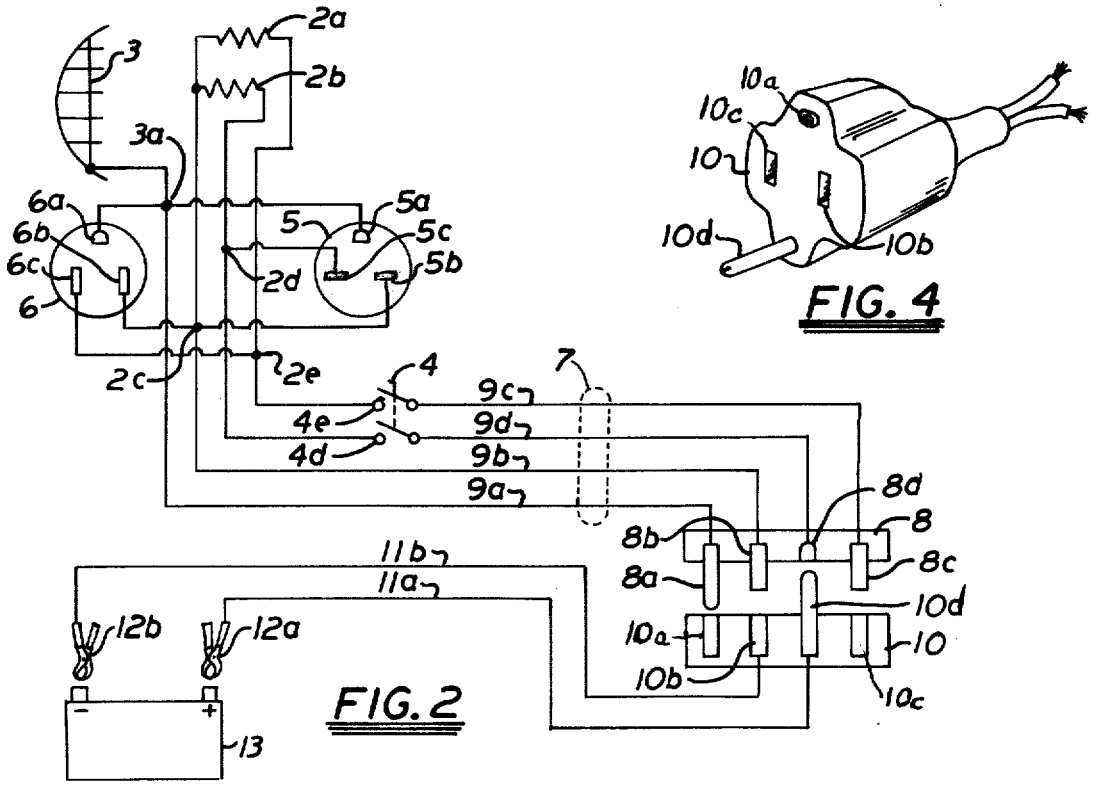
FIG. 2
FIG. 4

GROUNDED DUAL VOLTAGE TROUBLE LIGHT AND EXTENSION CORD

This invention is an A.C.-D.C. trouble light and extension cord which is useful for garage or field servicing of automotive vehicles and the like.

In the drawing,

FIG. 1 shows a preferred form of trouble light;

FIG. 2 is a circuit diagram, and

FIGS. 3 and 4 are perspectives of the connectors.

Referring to the drawing, 1 indicates a lamp holder, 2 indicates an incandescent lamp bulb, 3 indicates a combined lamp guard and reflector mounted on the lamp holder, 4 indicates a two pole signle throw switch for controlling circuits to the low and high voltage filaments of lamp bulb 2 and to low voltage socket 5 and high voltage socket 6 on the lamp holder. When the switch 4 is on, power circuits are closed to the shockets 5, 6 and to the filaments of lamp 2.

The lamp holder is supplied by a four conductor extension cord set 7 terminating in a plug 8 having a prong 8*a* for connection with the ground terminal of a standard 120 volt grounded A.C. socket, and prongs 8*b* and 8*c* for connection to the live contacts of the A.C. socket. When the plug 8 is plugged into a standard A.C. grounded socket, ground pin 8*a* is connected by conductor 9*a* to a terminal 3*a* connected to the guard 3 and to ground terminals 5*a* and 6*a* of sockets 5, 6 in the lamp holder 1. Live terminals 8*b* and 8*c* are respectively connected to conductors 9*b* and 9*c*. The conductor 9*b* is connected to terminal 2*c* connected to socket terminals 5*b* and 6*b* of sockets 5 and 6 and to one end of lamp filaments 2*a* and 2*b*. Conductor 9*c* is connected through switch contact 4*e* and to terminal 2*e* for lamp filament 2*a* and for terminal 6*c* of socket 6. When used on A.C., conductor 9*d* connected between terminal 8*d* of plug 8 through switch contact 4*d* to terminal 2*d* for lamp filament 2*b* is idle.

When used on D.C., plug 8 is plugged into receptacle 10 having wires 11*a* and 11*b* respectively connected to connectors 12*a*, 12*b* for making connections to the positive and negative terminals of a battery 13. Prong 10*d* connected to conductor 11*a* is plugged into female connector 8*d* connecting the positive terminal of the battery to conductor 9*d* which leads through switch contact 4*d* to terminal 2*d* connected to the low voltage filament 2*b* and to terminal 5*c* of socket 5. Prong 8*b* on connector 8 is received in female connector 10*b* in socket 10 connecting the negative terminal of battery 13 through conductor 9*b* to the common terminal 2*c* for lamp filaments 2*a* and 2*b*. Pin 8*a* and prong 8*c* respectively dead end in sockets 10*a* and 10*c*. When the plug 8 is plugged into receptacle 10 the lamp filament 2*b* is lighted when the switch contact 4*d* is closed. When the switch contacts 4*d* is closed battery power is also available at socket contacts 5*b* and 5*c*. These contacts are in horizontal alignment with each other instead of being parallel to each other as required by the 110 volt sockets so that there is no danger in plugging a 110 volt appliance into a battery power socket and vice versa. The guard or reflector is grounded for both battery and A.C. power so the user is protected.

I claim:

1. A dual voltage trouble light and extension cord comprising a lamp holder (6) for a lamp bulb (2) having a high voltage A.C. filament (2*a*) and a low voltage D.C. filament (2*b*)

a lamp guard (3) mounted on the lamp holder, a four conductor extension cored set (7) having a first plug (8) at one end and having the other end connected to said lamp holder (6), said first plug (8) having a first (8*c*) and second (8*b*) A.C. prongs, a ground pin (8*a*), and a female connector (8*d*), the prongs and ground pin being in grounded socket configuration, the first conductor (9*a*) of said cord set connected from said ground pin (8*a*) to a first terminal (3*a*) in said lamp holder connected to said lamp guard (3), the second conductor (9*c*) of said cord set connected from the first prong (8*c*) to a second terminal (2*e*) in said lamp holder connected to one end of said high voltage filament (2*a*), the third conductor (9*d*) of said cord set connected from said female connector (8*d*) to a third terminal (2*d*) in said lamp holder connected to one end of said low voltage filament (2*b*), the fourth conductor (9*b*) of said cord set connected from the second prong (8*b*) to a fourth terminal (2*c*) in said lamp holder connected to the other ends of said filaments (2*a*, 2*b*), a two pole switch in said lamp holder, one pole (4*e*) controlling the circuit in said second conductor (9*c*) to said second terminal (2*e*) and the other pole (4*d*) controlling the circuit in said third conductor (9*d*) to said third terminal (2*d*), a battery voltage socket (5) in said lamp holder having a ground contact (5*a*) connected to said first terminal (3*a*) and power contacts (5*c*, 5*d*) connected respectively to said third (2*d*) and fourth (2*c*) terminals, and an A.C. voltage socket (6) in said lamp holder having a ground contact (6*a*) connected to said first terminal (3*a*) and power contracts (6*c*, 6*b*) connected respectively to said second (2*e*) and fourth (2*c*) terminals.

2. The combination of claim 1 plus a second plug (10) having a female contact (10*b*) receiving said second prong (8*b*) of said first plug (8) and a male contact (10*d*) received in the female connector (8*d*) of said first plug (8), said contacts of the second plug being adapted to be connected to one and the other terminals of a battery.

3. The combination of claim 1 plus means for connecting said second prong (8*b*) of said first plug (8) and said female connector (8*d*) of said first plug respectively to one and the other terminals of a battery.

* * * * *